US007428972B2

(12) United States Patent
Warner et al.

(10) Patent No.: US 7,428,972 B2
(45) Date of Patent: Sep. 30, 2008

(54) PEG-BOARD MOUNTED, BIN SUPPORT BRACKET APPARATUS

(76) Inventors: James E. Warner, 2-22nd St. SW., Minot, ND (US) 58701; Frank M. Kostelnik, 1941 10th St. NW., Minot, ND (US) 58703; Frank J. Thomson, 2909 1st Ave. SW., Minot, ND (US) 58701

( * ) Notice: Subject to any disclaimer, the term of this patent is extended or adjusted under 35 U.S.C. 154(b) by 356 days.

(21) Appl. No.: 11/065,506

(22) Filed: Feb. 24, 2005

(65) Prior Publication Data

US 2005/0189308 A1 Sep. 1, 2005

Related U.S. Application Data

(60) Provisional application No. 60/548,833, filed on Feb. 27, 2004.

(51) Int. Cl.
*A47F 5/08* (2006.01)

(52) U.S. Cl. ..... 211/59.1; 211/94.01

(58) Field of Classification Search ..... 211/59.1, 211/57.1, 70.6, 88.01, 87.01, 94.01; 248/220.21, 248/220.22, 220.31, 220.41, 220.42
See application file for complete search history.

(56) References Cited

U.S. PATENT DOCUMENTS 4,151,917 A * 5/1979 Pugh ..... 211/88.01
4,228,906 A * 10/1980 Jones ..... 211/88.01
4,349,113 A * 9/1982 Schreiner ..... 211/103
4,452,360 A * 6/1984 Barnes ..... 211/59.1
4,687,094 A 8/1987 Allsop et al.
4,694,595 A * 9/1987 Fast ..... 40/642.01
4,898,354 A * 2/1990 Whittington et al. ... 248/220.22
5,109,992 A 5/1992 Miller
5,318,187 A 6/1994 Rosenthal
5,348,167 A * 9/1994 Jensen ..... 211/57.1
5,664,690 A 9/1997 Friesen
5,695,061 A 12/1997 Stompe
5,855,282 A * 1/1999 Hardy ..... 211/59.1
6,059,124 A * 5/2000 Weck et al. ..... 211/57.1
6,082,687 A * 7/2000 Kump et al. ..... 248/220.41
6,119,990 A * 9/2000 Kump et al. ..... 248/220.22
6,601,808 B1 * 8/2003 Nagel ..... 248/220.31
6,783,011 B2 * 8/2004 Rodrigue ..... 211/59.1

* cited by examiner

*Primary Examiner*—Jennifer E. Novosad

(57) ABSTRACT

A bin support bracket for mounting in holes in a peg board. A pair of support rods is provided wherein each support rod includes a top hole-engaging member and a bracket-supporting portion which extends downward from the top hole-engaging portion. A bin-support bracket is spanning the support rods. The bin-support bracket includes a forwardly and upwardly projecting bin-support flange portion. A storage bin includes a lip which engages the bin-support flange portion for supporting the storage bin on the bin-support bracket. The bin-support bracket further includes a forwardly and downwardly projecting bin-levelling flange portion to maintain a supported storage bin in a vertical orientation with respect to a peg board.

3 Claims, 5 Drawing Sheets

FIG 1
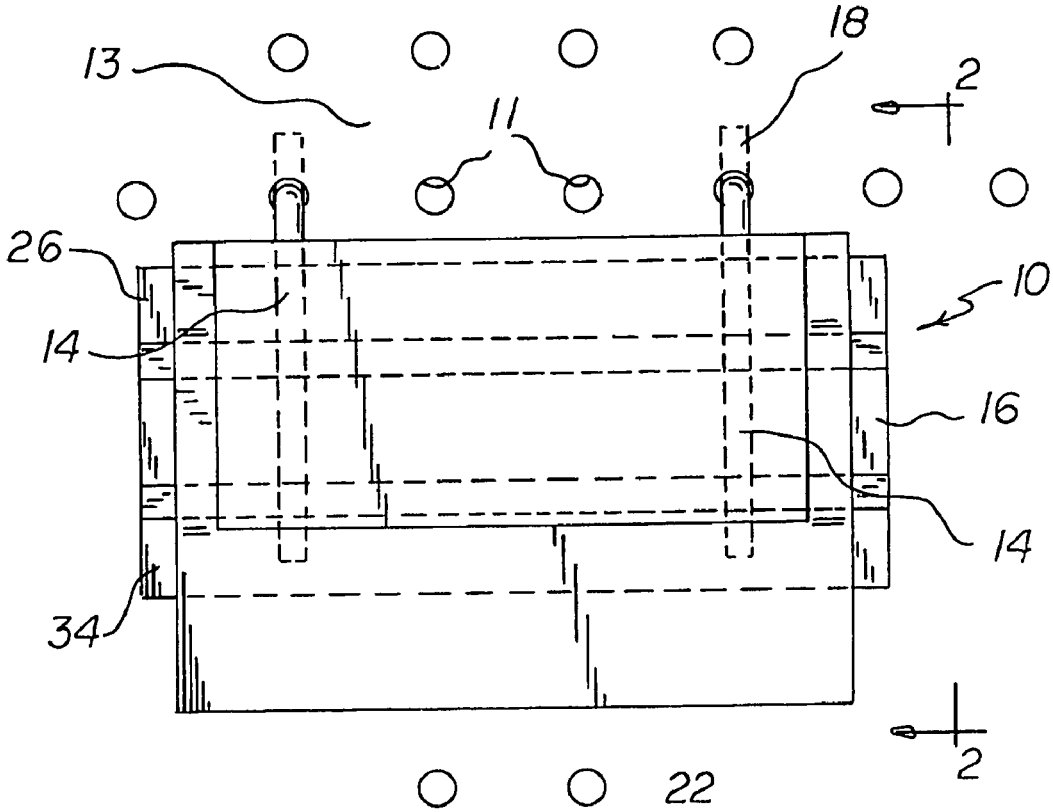
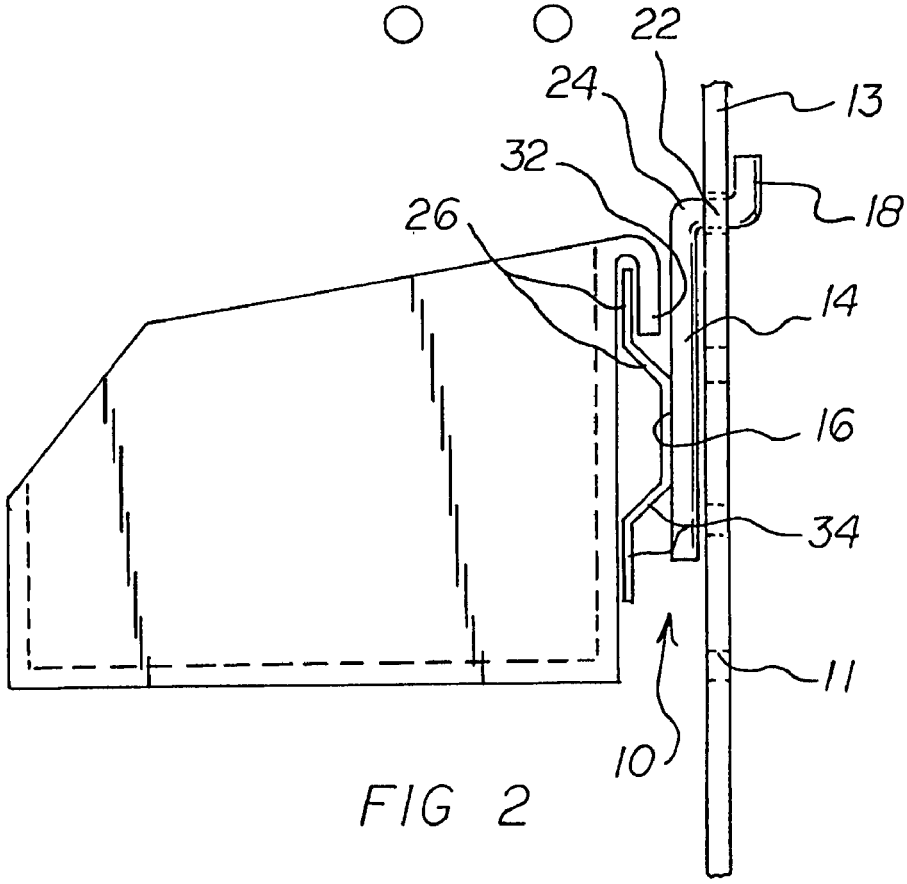
FIG 2

PEG-BOARD MOUNTED, BIN SUPPORT BRACKET APPARATUS

CROSS-REFERENCE TO RELATED APPLICATION

This application claims priority based upon my Provisional Application Ser. No. 60/548,833, filed Feb. 27, 2004.

BACKGROUND OF THE INVENTION

1. Field of the Invention

The present invention relates generally to devices mounted on peg boards, and, more particularly, to devices mounted on peg boards that are especially adapted for moving containers horizontally along the peg boards.

2. Description of the Prior Art

Peg boards are well known in the art for mounting items on a vertically oriented surface. In this respect, throughout the years, a number of innovations have been developed relating to mounting items on vertically oriented peg boards, and the following U.S. Pat. Nos. are representative of some of those innovations: 4,687,094, 5,109,992, 5,318,187, 5,664,690, and 5,695,061.

More specifically, U.S. Pat. No. 4,687,094 discloses a container display which is mounted in holes in a peg board using mounting rods. Each mounting rod has a peg-board end received in a peg board hole and a container end received in the container. Generally, each container has two mounting rods. If it is desired to move the location of the container horizontally along the peg board, then a pair of mounting rods must be removed from a pair of holes in the peg board, the container and mounting rods must be moved horizontally, and the mounting rod peg-board ends must be re-inserted in another pair of holes in the peg board. This process of repositioning horizontally is very laborious and time consuming. In this respect, it would be desirable if a device for mounting a container on a peg board were provided which does not require mounting rods to be removed from the peg board and re-positioned along the peg board when the container is re-positioned horizontally along the peg board.

U.S. Pat. No. 5,109,992 discloses an adjustable peg hook device in which a suspension bracket is mounted on a peg board. The suspension bracket has a pair of channel passages, and the channel passages include nodule-reception portions. The peg hook is mounted on a support plate which includes locking nodules, and the support plate is received horizontally in the channel passages of the suspension bracket. When the locking nodules engage the nodule-reception portions, the support plate is locked into a horizontal position. With respect to this adjustable peg hook device, it is noted that the support plate does not support a container. In this respect, it would be desirable if a device for mounting a container on a peg board were provided which includes a support plate that is horizontally received in a suspension bracket which is mounted on a peg board. In addition, it would be desirable if a container support plate and a suspension bracket mounted on a peg board did not include locking nodules and nodule-reception portions, respectively. Such locking nodules and nodule-reception portions impede horizontal motion of a support plate along a suspension bracket.

U.S. Pat. No. 5,318,187 discloses merchandising systems mounted on a peg board. Mounting rods are unified with a rack for holding containers, and each mounting rod has a peg-board end received in a peg board hole. Generally, each container has two mounting rods. If it is desired to move the location of the container rack horizontally along the peg board, then a pair of mounting rods must be removed from a pair of holes in the peg board, the rack with their mounting rods must be moved horizontally, and the mounting rods of the rack must be re-inserted in another pair of holes in the peg board. In this respect, it would be desirable if a peg-board-mounted device does not require mounting rods to be removed from the peg board and re-positioned along the peg board when a rack holding containers is re-positioned horizontally along the peg board.

U.S. Pat. No. 5,664,690 discloses a sliding display drawer that is supported by a rack that is mounted on a peg board. The drawer can be slid vertically with respect to the peg board when the rack is supported by the peg board. As with U.S. Pat. No. 5,318,187, if it is desired to move the location of the display drawer rack horizontally along the peg board, then, undesirably, a pair of mounting rods must be removed from a pair of holes in the peg board, the rack with their mounting rods must be moved horizontally, and the mounting rods of the rack must be re-inserted in another pair of holes in the peg board.

U.S. Pat. No. 5,695,061 discloses a literature holder that is mounted on a peg board. Similarly, with respect to respective descriptions above with respect to other devices, if it is desired to move the location of the literature holder horizontally along the peg board, then, undesirably, a pair of mounting pegs must be removed from a pair of holes in the peg board, the literature holder and the mounting pegs must be re-positioned horizontally along the peg board, and the mounting pegs must be re-inserted in another pair of holes in the peg board at the new horizontal position.

Still other features would be desirable in an apparatus for supporting containers or bins on a peg board. For example, rather than having a pair of mounting rods for each container or bin, it would be desirable if a device were provided wherein multiple containers or bins can be supported by a single bracket that is supported by only one pair of mounting rods mounted on a peg board. This would dramatically reduce the number of mounting rods that are required to support plural containers or bins.

Moreover, to further reduce the number of mounting rods required to support a plurality of containers or bins, it would be desirable if a device were provided wherein only one pair of mounting rods can support plural brackets, and wherein each of the plural brackets can support plural containers or bins.

Furthermore, if it becomes desirable to remove an entire set of container or bins from a specific peg board, such as for transporting the containers or bins to another location, it would be desirable if a device were provided wherein an entire set of containers or bins could be removed from a peg board by simply removing one pair of mounting rods from the peg board.

Thus, while the foregoing body of prior art indicates it to be well known to use a peg board for supporting containers or bins thereon, the prior art described above does not teach or suggest a peg board mounted, bin support bracket apparatus which has the following combination of desirable features: (1) does not require mounting rods to be removed from the peg board and re-positioned along the peg board when the container is re-positioned horizontally along the peg board; (2) provides a device for mounting a container on a peg board which includes a support plate that is horizontally received in a suspension bracket which is mounted on a peg board; (3) provides a container support plate and a suspension bracket mounted on a peg board that does not include locking nodules and nodule-reception portions; (4) provides a peg-board-mounted device which does not require mounting rods to be removed from the peg board and re-positioned along the peg board when a rack holding containers is re-positioned horizontally along the peg board; (5) provides that multiple containers or bins can be supported by a single bracket that is supported by only one pair of mounting rods mounted on a peg board; (6) provides that only one pair of mounting rods can support plural brackets, and that each of the plural brackets can support plural containers or bins; and (7) provides that an entire set of containers or bins can be removed from a peg board by simply removing one pair of mounting rods from the peg board. The foregoing desired characteristics are provided by the unique peg board mounted, bin support bracket apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a bin support bracket apparatus for mounting in holes in a peg board and includes a pair of support rods, wherein each support rod includes top hole-engaging means and a bracket-supporting portion which extends downward from the top hole-engaging means. In addition, a bin-support bracket is spanning the support rods.

Preferably, the top hole-engaging means include an upwardly extending, vertical wall engaging rod portion. A horizontally extending through-hole rod portion is connected to the vertical wall engaging rod portion. A downwardly extending bend portion is connected to the through-hole rod portion. The bracket-supporting portion is connected to the downwardly extending bend portion.

Preferably, the bin-support bracket also includes a forwardly and upwardly projecting bin-support flange portion. One or more storage bins are supported by the bin-support bracket. Each storage bin includes a rearwardly and downwardly extending lip which engages the forwardly and upwardly projecting bin-support flange portion for supporting the storage bin on the bin-support bracket.

Preferably, in addition, the bin-support bracket includes a forwardly and downwardly projecting bin-levelling flange portion. Preferably, the front portion of the bin-support flange portion and the front portion of the bin-levelling flange portion are in a common vertical plane in front of the peg board.

With another embodiment of the invention, a second bin-support bracket is supported by the support rods. The second bin-support bracket is supported by the support rods below a first bin-support bracket.

The peg board mounted, bin support bracket apparatus of the invention permits storage bins to be removed easily from a wall-mounted peg board without having to lift and turn the bins, thereby preventing spillage of the contents of the bins.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a number of preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved peg board mounted, bin support bracket apparatus which has all of the advantages of the prior art and none of the disadvantages.

It is another object of the present invention to provide a new and improved peg board mounted, bin support bracket apparatus which may be easily and efficiently manufactured and marketed.

It is a further object of the present invention to provide a new and improved peg board mounted, bin support bracket apparatus which is of durable and reliable construction.

An even further object of the present invention is to provide a new and improved peg board mounted, bin support bracket apparatus which is susceptible of a low cost of manufacture with regard to both materials and labor, and which accordingly is then susceptible of low prices of sale to the consuming public, thereby making such peg board mounted, bin support bracket apparatus available to the buying public.

Still yet a further object of the present invention is to provide a new and improved peg board mounted, bin support bracket apparatus which does not require mounting rods to be removed from the peg board and re-positioned along the peg board when the container is re-positioned horizontally along the peg board.

Still another object of the present invention is to provide a new and improved peg board mounted, bin support bracket apparatus that provides a device for mounting a container on a peg board which includes a support plate that is horizontally received in a suspension bracket which is mounted on a peg board.

Yet another object of the present invention is to provide a new and improved peg board mounted, bin support bracket apparatus which provides a container support plate and a suspension bracket mounted on a peg board that does not include locking nodules and nodule-reception portions.

Even another object of the present invention is to provide a new and improved peg board mounted, bin support bracket apparatus that provides a peg-board-mounted device which does not require mounting rods to be removed from the peg board and re-positioned along the peg board when a rack holding containers is re-positioned horizontally along the peg board.

Still a further object of the present invention is to provide a new and improved peg board mounted, bin support bracket apparatus which provides that multiple containers or bins can be supported by a single bracket that is supported by only one pair of mounting rods mounted on a peg board.

Yet another object of the present invention is to provide a new and improved peg board mounted, bin support bracket apparatus that provides that only one pair of mounting rods can support plural brackets, and that each of the plural brackets can support plural containers or bins.

Still another object of the present invention is to provide a new and improved peg board mounted, bin support bracket apparatus which provides that an entire set of containers or bins can be removed from a peg board by simply removing one pair of mounting rods from the peg board.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a front view showing a first embodiment of the bin support bracket apparatus of the invention, mounted on a peg board and supporting a single storage bin.

FIG. 2 is a side view of the embodiment of the peg board mounted, bin support bracket apparatus shown in FIG. 1 taken along line 2-2 of FIG. 1.

DESCRIPTION OF THE PREFERRED EMBODIMENT

With reference to the drawings, a new and improved peg board mounted, bin support bracket apparatus embodying the principles and concepts of the present invention will be described.

Figure 3:
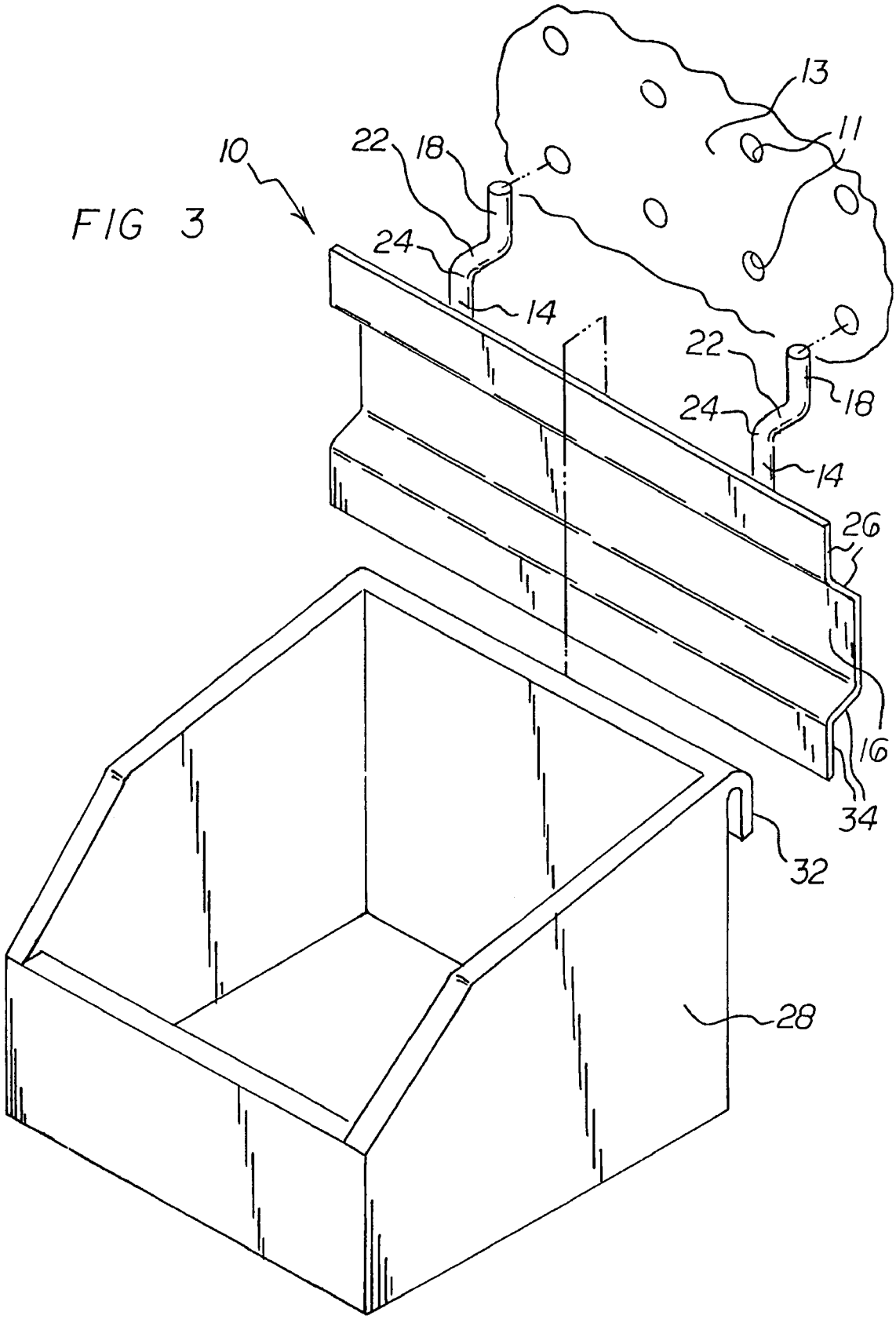
FIG. 3 is an exploded perspective view of the embodiment of the peg board mounted, bin support bracket apparatus of FIG. 2.

Turning to FIGS. 1-3, there is shown a first embodiment of the peg board mounted, bin support bracket apparatus of the invention generally designated by reference numeral 10. In the first embodiment, the bin support bracket apparatus 10 is provided for mounting in holes 11 in a peg board 13 and includes a pair of support rods, wherein each support rod includes top hole-engaging means and a bracket-supporting portion 14 which extends downward from the top hole-engaging means. In addition, a bin-support bracket 16 is spanning the support rods.

Preferably, the top hole-engaging means include an upwardly extending, vertical wall engaging rod portion 18. A horizontally extending through-hole rod portion 22 is connected to the vertical wall engaging rod portion 18. A downwardly extending bend portion 24 is connected to the through-hole rod portion 22. The bracket-supporting portion 14 is connected to the downwardly extending bend portion 24. The bracket-supporting portions 14 can be welded to the back portion of the bin-support bracket 16.

In general, the support rods are spaced apart from each other laterally, so they are in registration with holes 11 in the peg board 13.

Preferably, the bin-support bracket 16 also includes a forwardly and upwardly projecting bin-support flange portion 26. One or more storage bins 28 are supported by the bin-support bracket 16. Each storage bin 28 includes a rearwardly and downwardly extending lip 32 which engages the forwardly and upwardly projecting bin-support flange portion 26 for supporting the storage bin 28 on the bin-support bracket 16.

Preferably, in addition, the bin-support bracket 16 includes a forwardly and downwardly projecting bin-levelling flange portion 34. Preferably, the front portion of the bin-support flange portion 26 and the front portion of the bin-levelling flange portion 34 are in a common vertical plane in front of the peg board 13.

As with the fourth embodiment of the invention 40, a second bin-support bracket 16 is supported by the support rods. The second bin-support bracket 16 is supported by the support rods below a first bin-support bracket 16.

To use any of the embodiments of the invention, the apparatus 10 is grasped by a person and is oriented so that the wall engaging rod portions 18 are in a horizontal orientation. Then, the wall engaging rod portions 18 are moved through a pair of holes 11 in the peg board 13. Then, the apparatus 10 is rotated downward and pushed toward the peg board 13 so that the wall engaging rod portions 18 are oriented vertically behind the peg board 13, so that the through-hole rod portions 22 are oriented horizontally in the holes 11, and so that the bracket-supporting portions 14 are oriented vertically in front of the peg board 13 as shown in the drawing figures. Then, the rearwardly and downwardly extending lip 32 of a relatively short storage bin 28 is placed over the forward portion of the forwardly and upwardly projecting bin-support flange portion 26, whereby the relatively short storage bin 28 is supported by the peg board mounted, bin support bracket apparatus 10 of the invention.

Moreover, the forward portion of the bin-levelling flange portion 34 is in contact with a bottom portion of the storage bin 28 and keeps the storage bin 28 in a vertical orientation.

Figure 4:
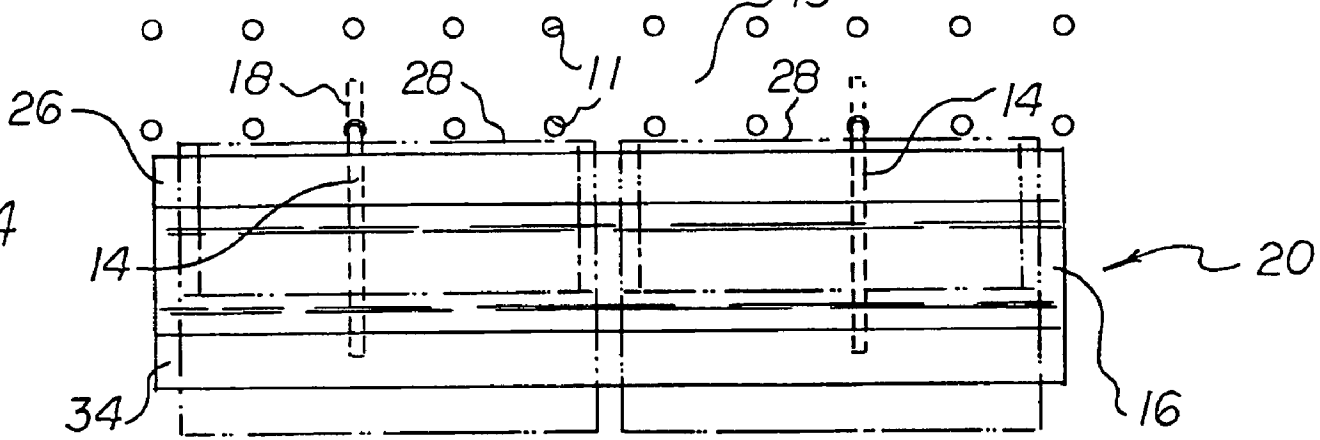
FIG. 4 is a front view of a second embodiment of the invention which supports two relatively short storage bins.

With the second embodiment of the invention 20 shown in FIG. 4, two relatively short storage bins 28 are supported by the apparatus. The respective positions of the storage bins 28 can be moved horizontally along the support bracket 16 without removing the support rods from the holes 11 in the peg board 13.

Figure 5:
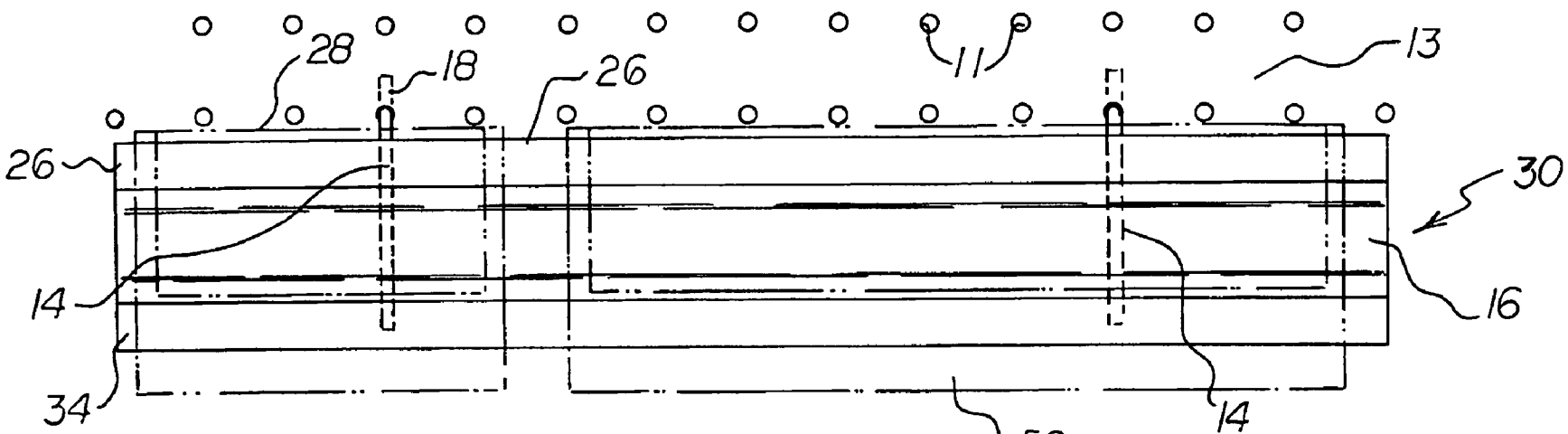
FIG. 5 is a front view of a third embodiment of the invention which supports one relatively short storage bin and one relatively long storage bin.

With the third embodiment of the invention 30 shown in FIG. 5, one relatively short storage bin 28 and one relatively long storage bin 52 are supported by the apparatus. The respective positions of the storage bins 28 and 52 can be moved horizontally along the support bracket 16 without removing the support rods from the holes 11 in the peg board 13.

Figure 6:
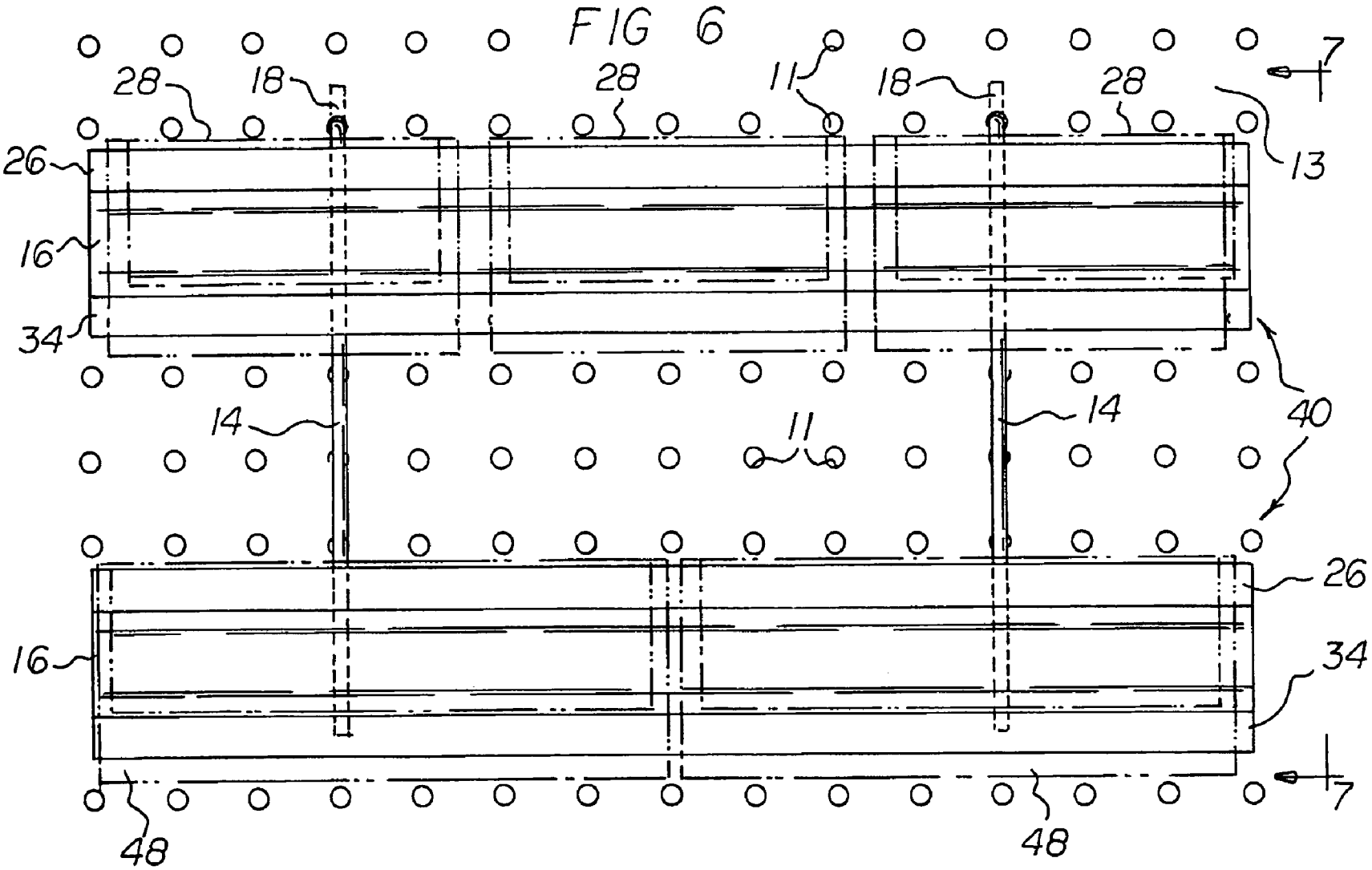
FIG. 6 is a front view of a fourth embodiment of the invention which supports an upper set of storage bins and a lower set of storage bins.
Figure 7:
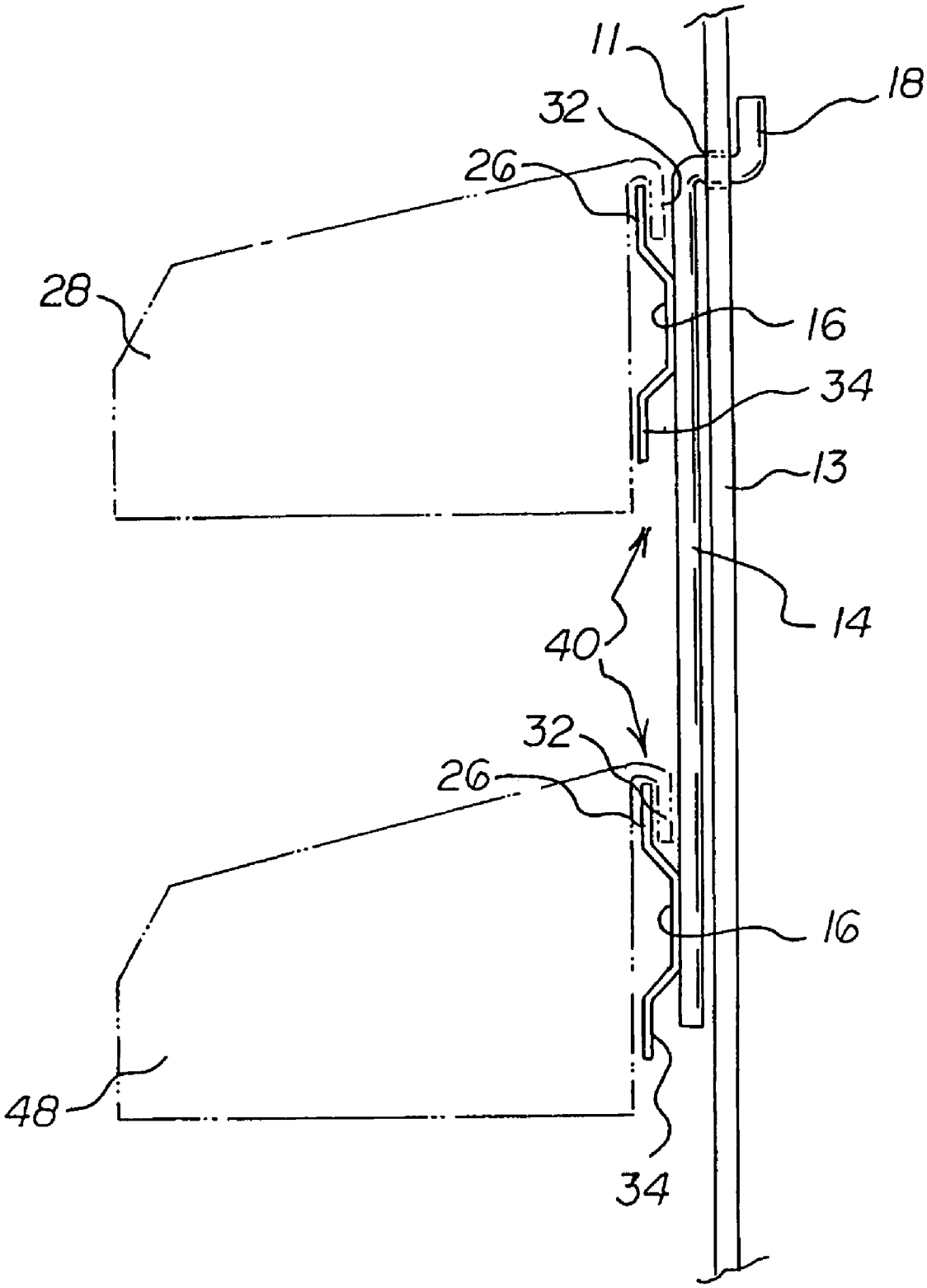
FIG. 7 is a side view of the embodiment of the invention shown in FIG. 6, taken along line 7-7 thereof.

With the fourth embodiment of the invention 40 shown in FIGS. 6 and 7, three relatively short storage bins 28 are supported by upper bin-support bracket 16, and two medium length storage bins 48 are supported by lower bin-support bracket 16. With the fourth embodiment of the invention, all of the support rods, brackets 16, and containers 28 can be removed from the peg board 13 by simply removing the single pair of support rods from the peg board 13.

A peg board 13 often includes either ⅛ inch or ¼ inch holes 11. In this respect, the outer diameter of the support rods can be less than either ⅛ inch or ¼ inch. The bin-support brackets 16 can be made from 16 gauge (1/16 inch) galvanized steel.

In general the bin-support brackets 16 can be any suitable length. In this respect, the lengths of the bin-support brackets 16 can be made to accommodate as many bins as desired, such as, for example, 1, 2, 3, 4, or 6 bins.

The peg board mounted, bin support bracket apparatuses of the invention permit storage bins to be removed from a wall-mounted peg board 13 easily without having to lift and turn the bins, thereby preventing spillage of the contents of the bins.

The components of the peg board mounted, bin support bracket apparatus of the invention can be made from inexpensive and durable metal and plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved peg board mounted, bin support bracket apparatus that is low in cost, relatively simple in design and operation, and which may advantageously be used without requiring mounting rods to be removed from the peg board and re-positioned along the peg board when the container is re-positioned horizontally along the peg board. With the invention, a peg board mounted, bin support bracket apparatus provides a device for mounting a container on a peg board which includes a support plate that is horizontally received in a suspension bracket which is mounted on a peg board. With the invention, a peg board mounted, bin support bracket apparatus provides a container support plate and a suspension bracket mounted on a peg board that does not include locking nodules and nodule-reception portions. With the invention, a peg board mounted, bin support bracket apparatus provides a peg-board-mounted device which does not require mounting rods to be removed from the peg board and re-positioned along the peg board when a rack holding containers is re-positioned horizontally along the peg board. With the invention, a peg board mounted, bin support bracket apparatus provides that multiple containers or bins can be supported by a single bracket that is supported by only one pair of mounting rods mounted on a peg board. With the invention, a peg board mounted, bin support bracket apparatus provides that only one pair of mounting rods can support plural brackets, and that each of the plural brackets can support plural containers or bins. With the invention, a peg board mounted, bin support bracket apparatus provides that an entire set of containers or bins can be removed from a peg board by simply removing one pair of mounting rods from the peg board.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the annexed Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the United States is as follows:

1. A bin support bracket apparatus for mounting in holes in a peg board, comprising in combination:

a peg board, said peg board having at least one row of evenly spaced through holes, said row comprising a predetermined plurality of said through holes more than two in number, a pair of support rods, wherein each support rod includes a top hole-engaging portion and a bracket-supporting portion which extends downward from said top hole-engaging portion, and a bin-support bracket spanning and permanently affixed to said support rods, wherein said bin-support bracket includes a forwardly and upwardly projecting bin-support flange portion, wherein said top hole-engaging portion includes:

an upwardly extending vertical wall engaging rod portion, a horizontally extending through-hole rod portion connected to said upwardly extending vertical wall engaging rod portion, and a downwardly extending bend portion connected to said horizontally extending through-hole rod portion, wherein said bracket-supporting portion is connected to said downwardly extending bend portion, further including:

a storage bin supported by said bin-support bracket, wherein said storage bin includes a rearwardly and downwardly extending lip which engages said forwardly and upwardly projecting bin-support flange portion for supporting said storage bin on said bin-support bracket, wherein said bin-support bracket includes a forwardly and downwardly projecting bin-levelling flange portion, and wherein the front portion of said bin-support flange portion and the front portion of said bin-levelling flange portion are in a common vertical plane spaced in front of and substantially parallel to said peg board when each said top hole-engaging portion of said pair of support rods, respectively, engages a corresponding pair of through holes in said plurality thereof in said peg board row.

2. The apparatus of claim 1, further including: a second bin-support bracket supported by said support rods.

3. The apparatus of claim 2 wherein said second bin-support bracket is supported by said support rods below a first bin-support bracket.

* * * * *